US012429276B2

(12) United States Patent
Shin et al.

(10) Patent No.: US 12,429,276 B2
(45) Date of Patent: Sep. 30, 2025

(54) REFRIGERATOR

(71) Applicant: LG ELECTRONICS INC., Seoul (KR)

(72) Inventors: Jihong Shin, Seoul (KR); Mi Kyoung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 224 days.

(21) Appl. No.: 18/117,090

(22) Filed: Mar. 3, 2023

(65) Prior Publication Data

US 2023/0314066 A1 Oct. 5, 2023

(30) Foreign Application Priority Data

Mar. 11, 2022 (KR) ..... 10-2022-0031041

(51) Int. Cl.
*F25D 23/12* (2006.01)

(52) U.S. Cl.
CPC ..... *F25D 23/12* (2013.01); *F25D 2323/122* (2013.01); *F25D 2700/00* (2013.01)

(58) Field of Classification Search
CPC ..... F25C 2700/04; F25C 1/25; G01F 23/00; F25D 29/005; F25D 2700/00; F25D 2323/122
See application file for complete search history.

(56) References Cited

U.S. PATENT DOCUMENTS

2013/0133354 A1* 5/2013 Park ..... F25D 23/126 62/340
2018/0187964 A1 7/2018 Park et al.
2020/0355426 A1 11/2020 Park et al.
2021/0396459 A1 12/2021 Kwon et al.
2022/0090852 A1 3/2022 Park et al.

FOREIGN PATENT DOCUMENTS

EP 3760587 1/2021
KR 10-2018-0080056 7/2018

OTHER PUBLICATIONS

Extended European Search Report in European Appln. No. 23160878.7, mailed on Jul. 7, 2023, 6 pages.

* cited by examiner

*Primary Examiner* — Ana M Vazquez
(74) *Attorney, Agent, or Firm* — Fish & Richardson P.C.

(57) ABSTRACT

A refrigerator includes a water sensor unit secured to a case to overlap with a lower surface of a water tank, so that the water level sensor unit may maintain a constant position and operational stability may be increased, regardless of whether the water tank is mounted or demounted, and the upper surface of the water level sensor unit is inclined toward the front surface of the water level sensor unit, thereby reducing an operational error due to residual water.

22 Claims, 14 Drawing Sheets

REFRIGERATOR

CROSS-REFERENCE TO RELATED APPLICATION

This application claims priority to and the benefit of Korean Patent Application No. 10-2022-0031041, filed on Mar. 11, 2022, the disclosure of which is incorporated herein by reference in its entirety.

TECHNICAL FIELD

The present disclosure relates to a refrigerator, more particularly, a refrigerator that may reduce a malfunction of a water level sensor unit configured to sense a water level in a water tank and enhance operational stability.

BACKGROUND

A refrigerator is a home appliance configured to supply cold air generated by refrigerant circulation to a storage chamber (e.g., a refrigerator compartment or a freezer compartment) to keep various kinds of storage targets fresh for a long time in the storage chamber.

A refrigerator may include an icemaker configured to make ice, using cold air. The icemaker may make and keep a predetermined amount of ice.

To make ice, the icemaker must be supplied water. There are two methods of water supply to the icemaker as one example.

One method is a plumbing method of supplying water from an external water source such as tap water and the other one is a non-plumbing method of supplying water from a water container filled by a user.

In the non-plumbing method, a water level sensor unit is provided to control the amount of water supplied to the icemaker.

When water is supplied to the icemaker, the water in the water tank gradually decreases and the water supply progresses until a predetermined water shortage time point by detecting the water level of the water tank through the water level sensor unit. The water supply is stopped at a later time point and water shortage information may be provided to the user.

The water level sensor unit for detecting the water level in the water tank may be implemented in various ways.

As one example, the water level sensor unit, which is movable by an elastic pressing method such as a spring, may be disposed on a lateral surface of the water tank and configured to sense the water level on the lateral surface of the water tank by moving a position based on whether the water tank is mounted or demounted.

In the non-plumbing method, the user has to directly fill water in the water tank so that the water tank may be repeatedly mounted and demounted a very large number of times.

Since the mounting and demounting of the water tank is repeated, the elasticity of the spring moving the water level sensor unit might change or malfunction, which results in poor operation stability of the water level sensor unit.

Furthermore, since the water level is measured on the lateral surface of the water tank, there could be a malfunction in which a water level measurement error of the water level sensor unit occurs near a boundary line between a lower end of the water level sensor unit and the water.

SUMMARY

One objective of the present disclosure is to provide a refrigerator that may reduce a malfunction of a water level sensor unit configured to sense a water level in a water tank and enhance operational stability.

Another objective of the present disclosure is to provide a refrigerator that may improve assemblability by coupling a water level sensor unit to an inside of a water level sensor unit case to minimize damage.

A further objective of the present disclosure is to provide a refrigerator that may secure a water tank in order to minimize a distance between a water tank and a water level sensor unit.

A still further objective of the present disclosure is to provide a refrigerator that may reduce noise and vibration inside a pump configured to move water from a water tank to an icemaker.

A still further objective of the present disclosure is to provide a refrigerator that may reduce separation of a tube through which water flows from a pump.

A still further objective of the present disclosure is to provide a refrigerator that may prevent a pump inserted in a holder bracket from being lifted by buoyancy of molding liquid.

A still further objective of the present disclosure is to provide a refrigerator having a case accommodating a water tank, which may also guide movement of a storage part disposed adjacent to the water tank.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

To overcome the above-noted disadvantages, a refrigerator according to an embodiment may have a water sensor unit secured to a case to overlap with a lower surface of a water tank, the water level sensor unit having an upper surface inclined toward a front surface of the water tank.

Specifically, since the water level sensor unit is secured to the case to overlap the lower surface of the water tank, the water level sensor unit may maintain a constant position and operational stability may be increased, regardless of whether the water tank is mounted or demounted. Since the upper surface of the water level sensor unit is inclined toward the front surface of the water level sensor unit, an operational error due to residual water may be reduced.

The refrigerator may include a case; a water tank detachably mounted to the case; and a water level sensor unit secured to the case to overlap with a lower surface of the water tank and configured to detect a water level inside the water tank.

In this instance, an upper surface of the water level sensor unit may be inclined toward a front surface of the water tank.

The water tank may include an inlet portion recessed from a rear lower area of the water tank to accommodate the water level sensor.

The lower surface of the water tank may include a first bottom surface vertically overlapping with the water level sensor unit and a second bottom surface not vertically overlapping with the water level sensor unit. The first bottom surface may be inclined toward the front surface of the water tank.

The first bottom surface may be positioned in an upper area than the second bottom surface.

The case may include an opening to which the water level sensor unit is secured, and the upper surface of the water level sensor unit may be exposed outside through the opening.

The water level sensor unit may include a water level sensor; and a water level sensor case. The water level sensor may be secured to an inner upper surface of the water level sensor case by a sensor front hook disposed inside the front surface of the water level sensor case; and a pair of tension ribs including sensor side hooks arranged to face each other inside both sides of the water level sensor case.

An upper surface of the water level sensor unit and the first bottom surface may be in direct contact with each other.

A distance between an upper surface of the water level sensor unit and the first bottom surface may be 2 mm or less.

A lower surface of the water tank comprises a bottom connecting surface connecting the first bottom surface and the second bottom surface with each other. A distance between a front surface of the water level sensor unit and the bottom connecting surface may be farther than the distance between the upper surface of the water level sensor and the first bottom surface.

The refrigerator may further include a pump, and the case may include a water tank accommodating portion accommodating the water tank; a pump accommodating portion accommodating the pump; and one or more partition walls portioning off the water tank accommodating portion and the pump accommodating portion as separate spaces.

The case may be provided inside a refrigerator compartment.

The partition walls may include a first partition wall partitioning off the water tank accommodating portion and the pump accommodating portion; a second partition wall extending rearward from one side cross sectional end of the first partition wall; and a third partition wall extending rearward from an upper cross sectional end of the first partition wall. The water tank disposed in front of the first partition wall may be exposed to the outside of the refrigerator compartment.

The case may include a water tank accommodating portion accommodating the water tank. The water tank accommodating portion may include one or more of a first side securing portion disposed to secure a rear lateral surface of the water tank, a second side securing portion disposed to secure a front lateral surface of the water tank, and a bottom securing portion disposed to secure a front lower surface of the water tank.

The pair of first side securing portions protruding toward the water tank to face each other may be coupled to a pair of side recesses formed in both lateral surfaces of the water tank to lock the movement of the water tank.

The second side securing portion guiding the movement of the water tank may guide a water tank guide provided on a lateral surface of the water tank when the water tank is demounted.

The bottom securing portion protruding upward may contact a lower surface of the water tank to lock the movement of the water tank.

The refrigerator may further include a pump; and a holder bracket surrounding the pump. The pump accommodating portion may include a pair of second fastening portions fastening the holder bracket, and the holder bracket may include a pair of through-holes secured to the second fastening portions, respectively. The second fastening portion and the through-hole may be fastened to each other by a second fastening member, and a damper may be disposed between the through-hole and the second fastening portion to surround the second fastening portion.

The through-hole having a predetermined cut-away area may include a fitting guide protruding along an inner circumference of the through-hole, and the damper may include a guide coupling portion recessed along an outer circumference. The damper may be inserted in the through-hole having the cut-away area to fittingly couple the guide coupling portion to the fitting guide.

A washer may be provided between the second fastening member and the second fastening portion. One surface of the washer may contact the second fastening member and the other surface of the washer may contact the second fastening portion and the damper.

The refrigerator may further include a pump; and a holder bracket surrounding the pump. The holder bracket may include a body having one open surface in which the pump is inserted, and a securing rib protruding to lock the movement of the pump inserted in the body may be disposed inside the body.

The refrigerator may further include a third tube through which the water supplied from the water tank flows. The case may include a first locking portion, a second locking portion and a third locking portion hook-coupled to the third tube in different force directions.

The case may include a guide rail provided on one lateral surface of the case and configured to guide movement of a storage portion.

The present disclosure has following one or more effects. According to the present disclosure, since the water level sensor unit of the refrigerator is secured to the case to overlap the lower surface of the water tank, the water level sensor unit may maintain a constant position and operational stability may be increased, regardless of whether the water tank is mounted or demounted.

In addition, since the upper surface of the water level sensor unit is inclined toward the front surface of the water level sensor unit, an operational error due to residual water may be reduced.

In addition, the water level sensor may be primarily secured to the sensor front hook of the water level sensor case and secondarily secured by the pair of tension ribs including the sensor side hook, thereby enhancing assemblability and reducing damage or breakage of the water level sensor.

Accordingly, the water level sensor according to the present disclosure may be strongly secured to the inner upper surface of the water level sensor case to minimize gap.

In addition, one or more securing portions configured to strongly secure the water tank accommodated in the water tank accommodating portion of the case may be disposed on the lateral surface and/or the lower surface of the water tank. Accordingly, the water tank may be strongly secured to minimize the distance between the water tank and the water level sensor unit, thereby securing the operational stability of the water level sensor unit.

In addition, while the holder bracket surrounding the pump is fastened to the second fastening portion by the second fastening member, the damper surrounding the second fastening portion may be disposed between the holder bracket and the second fastening portion. Accordingly, noise and vibration of the pump may be reduced.

In addition, the tub through which water flows to the pump connected therewith may be coupled to the plurality of locking portions in different force directions, thereby reducing separation of the tube during work and part movement.

In addition, the securing rib protruding to lock the movement of the pump may be disposed inside the body of the holder bracket, thereby preventing the pump from being lifted by buoyancy due to the molding liquid injected into the holder bracket.

In addition, the guide rail guiding the movement of the storage portion may be disposed on one lateral surface of the case to which the water tank is mounted and demounted, thereby guiding the movement of the storage portion disposed adjacent to the water tank and enhancing space utilization.

Specific effects are described along with the above-described effects in the section of detailed description.

DETAILED DESCRIPTION

Figure 1:
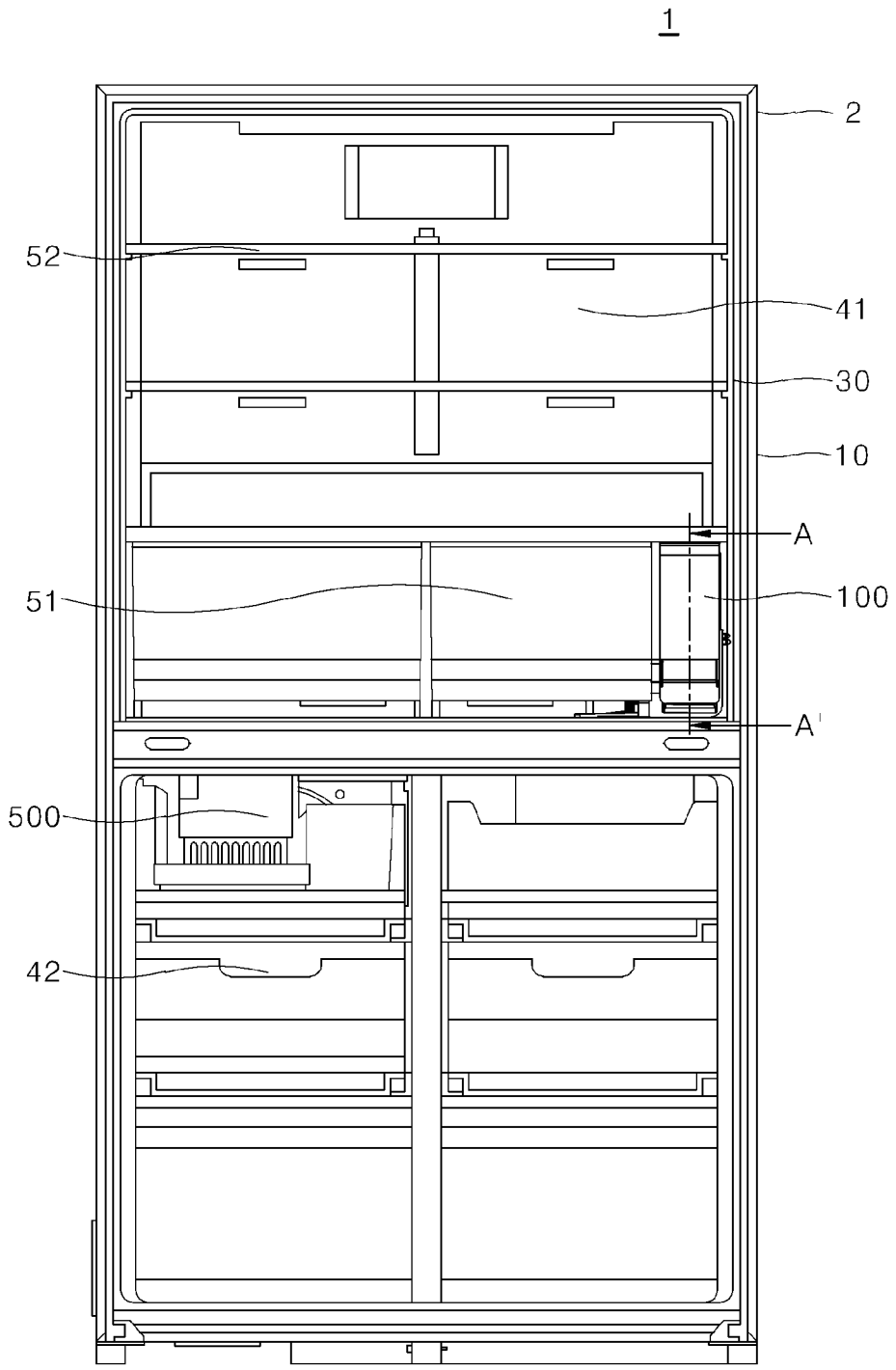
FIG. 1 is a front view of a refrigerator in which a door is eliminated.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Throughout the disclosure, the terms "A and/or B" as used herein can denote A, B or A and B, and the terms "C to D" can denote C or greater and D or less, unless stated to the contrary.

Hereinafter, a refrigerator according to several embodiments will be described.

FIG. 1 is a front view of a refrigerator in which a door is eliminated.

An exterior design of the refrigerator 1 may be defined by a cabinet 2 defining a storage space and a door configured to open and close an open front of the cabinet 2.

The cabinet 2 may include an outer case 10 forming an outer surface of the refrigerator 1 and an inner case 40 forming an inner surface of the outer case 10.

The outer case 10 and the inner case 40 may be spaced a preset distance apart from each other and an insulating material is foamed in the space between them to fill the empty space with the insulating material.

A storage space inside the cabinet 2 may be divided into a plurality of spaces, which are a refrigerator compartment 41 and a freezer compartment 42.

In an embodiment of the present disclosure, the refrigerator compartment 41 may be disposed on the freezer compartment 42.

A door may be coupled to a front surface of the cabinet 2 to open and close the refrigerator 1.

The refrigerator compartment 41 and the freezer compartment 42 may include a plurality of storage parts 51 and a plurality of shelves 52 that are sliding-movable to be drawn out or in along a rail to easily store and preserve storing targets.

An icemaker 500 may be disposed in the freezer compartment 42 to make and store ice.

The icemaker 500 has to be supplied water to make ice.

A water tank 100 may be provided in the refrigerator compartment 41 and water inside the water tank 100 may be supplied to the icemaker 500.

The water tank 100 may be disposed in parallel with one or more storage parts 51.

Figure 2:
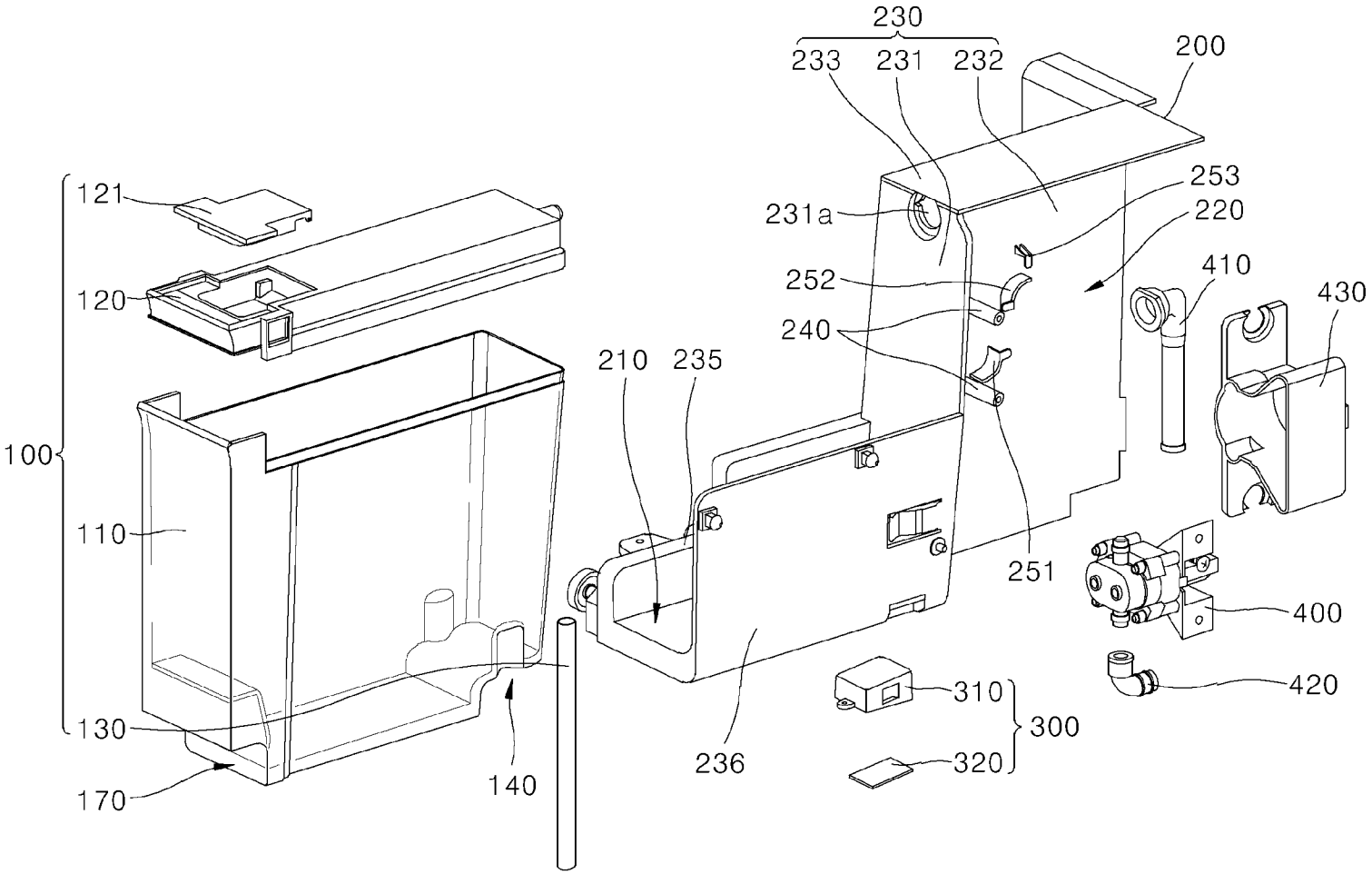
FIG. 2 is an exploded perspective view of a water tank, a case, a water level sensor unit, a pump and a holder bracket according to an embodiment.

Hereinafter, referring to FIGS. 2 to 4, the coupling relationship of the water tank, the case, a water level sensor unit, a pump and a holder bracket will be described.

The water tank and the case 200 configured to accommodate the water tank 100 may be disposed in the refrigerator compartment 41.

The case 200 may be partitioned off into a water tank accommodating portion 210 and a pump accommodating portion 220 as two different spaces by one or more partition walls 230.

For example, the one or more partition walls may include a first partition wall 231 configured to partition the space of the case into the water tank accommodating portion 210 and the pump accommodating portion 220.

A second partition wall 232 may extend backward from one lateral end of the first partition wall 231.

A third partition wall 233 may extend backward from an upper end of the first partition wall 231.

An upper end of the second partition wall 232 may come into contact with one lateral end of the third partition wall 233.

The case 200 may be closely secured to the inner case 30 so that the pump accommodating portion 220 defined by the first partition wall 231, the second partition wall 232 and the third partition wall 233 may not be exposed to the outside.

Accordingly, a pump 400 disposed behind the first partition wall 231 may not be exposed to the outside of the refrigerator compartment 41, which results in enhancing an aesthetic effect of the refrigerator compartment 41.

A finishing wall 234 may be additionally formed along a rear end surface of the second partition wall 232 to enhance the securing force and adhesion to the inner case 30 and serve as an aesthetic finishing material.

The pump accommodating portion 220 may be provided with a first tube 410 having one end connected with a communication hole 231*a* formed in an upper area of the first partition wall 231, a pump 400 connected with the other end of the first tube 410, a second tube 420 connected to one side of the pump 400, and a holder bracket 430 surrounding the pump 400.

The water tank 100 disposed in front of the first partition wall 231 may be exposed to the outside of the refrigerator compartment 41 so that the user can easily demount the water tank 100 from the case 200.

The water tank accommodating portion 210 accommodating the water tank 100 may be defined by the first partition wall 231, a first lateral wall 235 extending forward from one lateral end of the first partition wall 231, and a second lateral wall 236 extending forward from the other end.

The water tank 100 may be mountable to and demountable from the water tank accommodating portion 210.

The water level sensor unit 300 configured to detect a water level in the water tank 100 may include a water level sensor 320 and a sensor case 310. The water level sensor unit 300 may be secured to the case 200 to be positioned in the water tank accommodating portion 210.

The water tank 100 may include a water containing portion 110 containing water and a water tank cover 120 covering a top area of the water containing portion 110.

The water tank cover 120 may include a water tank cap 121 connected to be open and closed when water is filled in or discharged from.

A handle 170 may be formed on a front of the water containing portion by recessing a front lower area of the water containing portion 110 so that the user's hand may be inserted in the handle 170.

A water supply pipe 130 may be disposed inside the water containing portion 110 to flow the water from the water tank 100 to the first tube 410 connected through the communication hole 231*a*.

An inlet portion 140 recessed upward from a rear lower area of the water containing portion 110 to receive the water level sensor unit 300.

Figure 3:
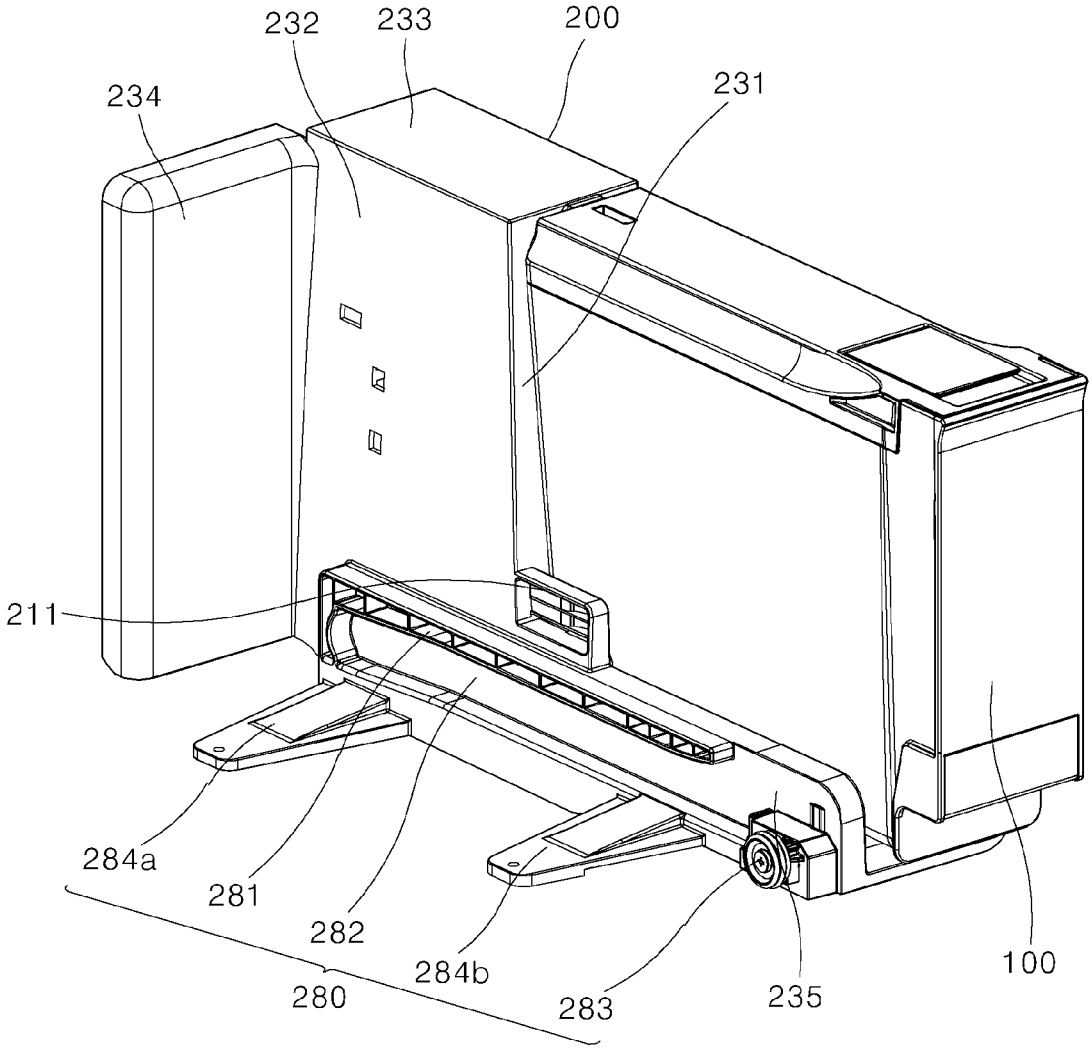
FIG. 3 is a perspective view showing a water tank accommodating portion accommodating a water tank that is coupled to the case.
Figure 4:
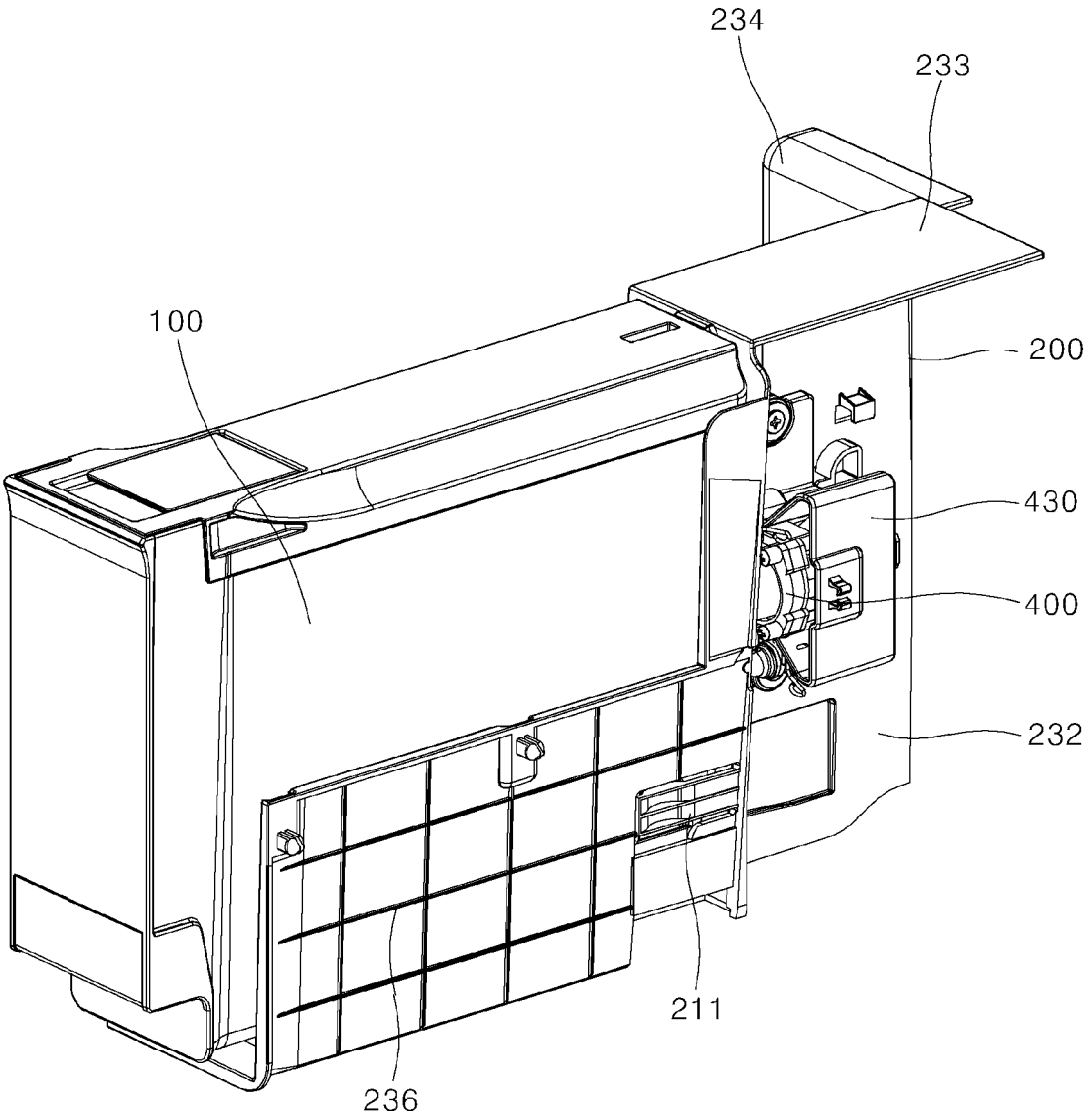
FIG. 4 is a perspective view showing a water tank accommodating portion accommodating a water tank coupled to a case.

Referring to FIG. 3, a guide rail 280 configured to guide the movement of the storage part 51 may be provided on the first lateral wall 235 provided on the lateral surface of the case 200 to be integrally formed with the case 200 disposed in parallel with the water tank 100. The guide rail 280 may include a rail 281 supporting one end of the storage part 51.

The rail 281 may be provided in an upper area of the first lateral wall 235 and configured to support one side of the storage part 51.

The rail 281 may be formed to have a hollow inside, and may be formed long in a front-back direction to have a predetermined thickness so that the storage part 510 may sliding-move in the front-back direction.

A plurality of ribs may be formed inside the hollow rail 281 to reinforce strength.

The guide rail 280 may include a first bottom securing portion 284*a* and a second bottom securing portion 284*b* that extend outward along a bottom of the first lateral wall 235 to secure the case 200 to the inner case 30.

The first bottom securing portion 284*a* may be disposed on a rear end area of the first lateral wall 235 and the second bottom securing portion 284*b* may be disposed on a front end of the first lateral wall 235 to maintain a balance of the securing strength.

A roller 283 may be formed on an area of the first lateral wall 235, which is in front of the rail 281, so that one of the storage part 51 may easily slide in the front-back direction.

A guide groove 282 recessed inward may be formed below the rail 281 to provide a passage of a wheel provided in the storage part 51.

As described above, a predetermined area of the guide rail 280 for guiding the movement of the storage part 51 may be integrally formed on one lateral surface of the case 200 to which the water tank 100 is detachably coupled, so that the movement of the storage part 51 disposed in parallel with the water tank 100 and space utilization can be increased.

Figure 5:
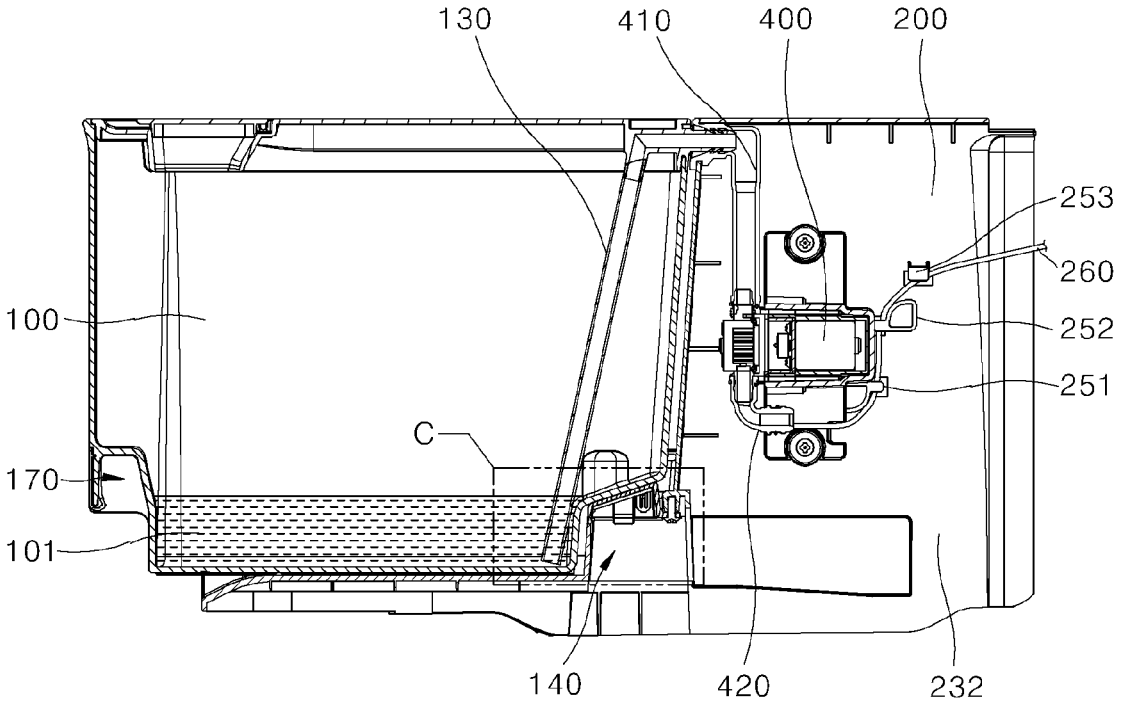
FIG. 5 is a sectional view along A-A' of FIG. 1.
Figure 6:
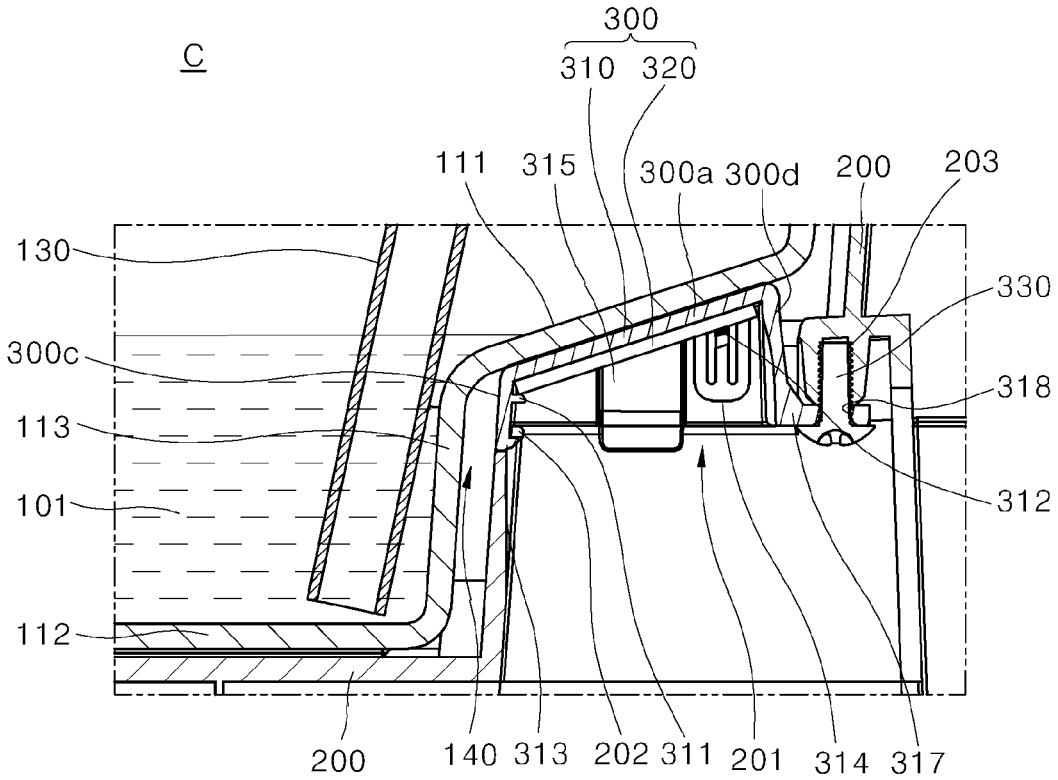
FIG. 6 is an enlarged sectional view of C shown in FIG. 5.
Figure 7:
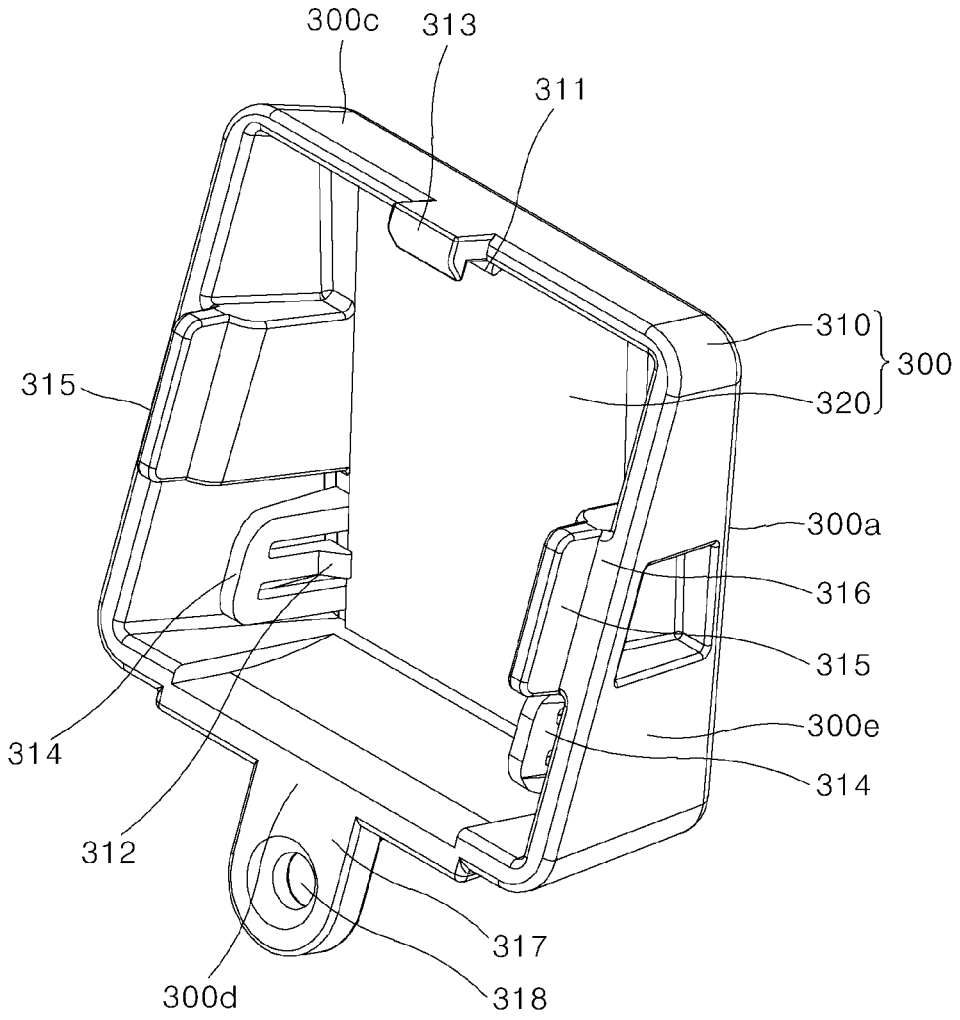
FIG. 7 is a perspective view showing a rear surface of a water level sensor unit.

Hereinafter, referring to FIGS. 5 to 7, the water level sensor unit 300 and the water tank 100 according to the present disclosure will be described.

The water 101 contained in the water tank 100 may be supplied to the icemaker 500 by the pump 400 operated, when a request for water supply is transmitted by the icemaker 500, through the first tube 410, the second tube 420 and third tube 260 and the water supply pipe 130.

The water supply pipe 130 and the pump 400 may be in communication through the first tube 410, and the pump 400 and the third tube 260 may be in communication through the second tube 420.

A valve may be disposed between the third tube 260 and the icemaker 500 to adjust the amount of water supplied, and the valve may be provided in a mechanical chamber of the refrigerator 1.

The water level sensor unit 300 may be secured to the case 200 to overlap with the lower surface of the water tank 100.

Specifically, the lower surface of the water tank 100 may include a first bottom surface 111 overlapping with the water level sensor unit 300 in a vertical direction, and a second bottom surface 112 not overlapping with the water level sensor unit 300 in the vertical direction.

The first bottom surface 111 may be positioned higher than the second bottom surface 112, and the first bottom surface 111 and the second bottom surface 112 may be connected with each other through a bottom connection surface 113.

Accordingly, the inlet portion 140 may be an empty space defined on a lower are of the outside of the water tank 100 by the first bottom surface 111 and the bottom connection surface 113.

The case 200 may include an opening 201 opened to secure the water level sensor unit 300.

The opening 201 may be formed to be open in a size corresponding to the water level sensor unit 300.

The opening 201 may be formed inside the inlet portion 140 of the water tank 100.

The water level sensor 320 may be disposed in a front surface of the water level sensor case 310 and primarily hooked by a sensor front hook 311 protruding inward from a front surface of the water level sensor case 310.

Accordingly, one side of the water level sensor is hooked to be secured between the sensor front hook 311 and an upper surface 300*a* of the water level sensor unit 300.

The water level sensor 320 may be secondarily hooked to be secured to an inner area of the upper surface 300*a* of the water level sensor unit 300 by a pair of tension ribs 314 each including a sensor side hook 312, which are formed on both lateral surfaces of the water level sensor case 310 to face each other.

The sensor side hook 312 may be connected to a center area of the tension ribs 314 to protrude to the inside of the water level sensor case 310.

The tension rib 314 having elasticity may be spaced a preset distance apart from a lateral surface 300*e* of the water level sensor unit 300.

Accordingly, when hooking to secure between the sensor side hook 312 and the upper surface 300*a* of the water level sensor unit 300, both of the tension ribs 314 may become widened toward the lateral surface 300*e* of the water level sensor unit 300 by elasticity, to easily insert the water level sensor 320.

In this instance, the sensor side hook 312 may have a surface inclined toward a direction in which the water level sensor 320 is inserted, in order to smoothly guide the securing of the water level sensor 320.

The water level sensor 320 may be primarily secured to the sensor front hook 311 of the water level sensor case 310 and secondarily secured by the pair of tension ribs 314 including the sensor side hook 312. Due to this structure, the water level sensor 320 is not forcedly fitted in an interference fitting method so that damage to the water level sensor 320 may be reduced and assembling properties may be improved at the same time.

The water level sensor 320 may be a capacitance sensor configured to detect the water level inside the water tank 100 by sensing a capacitance that changes based on the detected water level.

The water level sensor 320 may be configured to detect the water level inside the water tank 100 even without directly contacting the water 101 inside the water tank 100.

However, in order to reduce errors in detecting the water level and secure a minimum distance that can be detected, the distance between the water level sensor 320 and the water tank 100 may be reduced as much as possible.

Accordingly, due to the securing structure of the present disclosure described above, the water level sensor 320 may be strongly secured to the inner rear surface of the upper surface 300*a* of the water level sensor case 310 to minimize a gap so that sensibility of the water level sensor 320 may be increased and errors may be reduced at the same time.

A case fixing hook 313 having a shape extending downward to be bent may be formed in a center area of the front surface 300*c* of the water level sensor unit 300.

The case fixing hook 313 may be hooked to a hook locking hole 202 formed in the opening 201 of the case 200 to couple the front surface 300*c* of the water level sensor unit 300 to the opening 201 to couple the front surface 300*c* of the water level sensor unit 300 to the opening 201.

In addition, a case fixing extension 317 may extend from a rear surface 300*d* of the water level sensor case 310.

The case fixing extension 317 may have an extension-through hole 318 disposed between a first fastening portion 203 formed in the opening 201 and a first fastening member 330.

Accordingly, the rear surface 300*d* of the water level sensor unit 300 may be coupled to the opening 201.

For example, the first fastening member 330 may be a bolt and the case fixing extension 317 may be disposed between the first fastening portion 203 and the first fastening member 330 to be strongly fixe by the screw fastening of the first fastening member 330 and the first fastening portion 203.

The first fastening portion 203 may have an opening formed downward so that it can be screw-fastened to receive force from the bottom to the top.

A pair of side guides 315 may extend downward from both lateral surfaces 300*e* of the water level sensor unit 300, respectively.

The side guides 315 may be disposed in an inner position than the lateral surfaces 300*e* of the water level sensor case 310 to protrude downward. To this regard, a case seating portion 316 having a predetermined thickness may be formed on a lateral surface of the side guide 315.

The pair of side guides 315 may be configured to guide the coupling of the water level sensor unit 300 to the opening 201 of the case 200.

The case seating portion 316 may be an area fixed in contact with the opening 201. The water level sensor unit 300 may be coupled by the contact between the case seating portion 316 and the opening 201 to receive force from the top to the bottom.

Since the water level sensor unit 300 receives forces in difference directions when the first fastening member 330 and the first fastening portion 203 are coupled and when the case seating portion 316 and the opening 201 are coupled.

As described above, the water level sensor unit 300 may be firmly secured to the case 200 to overlap with the lower surface of the water tank 100. Accordingly, regardless of whether or not the water tank 100 is repeatedly mounted or demounted, the water level sensor unit 300 may maintain a constant position, thereby increasing operational stability.

The upper surface 300*a* of the water level sensor unit 300 coupled to the opening 201 may be exposed to the outside through the opening 201.

The upper surface 300*a* of the water level sensor unit 300 may have a shape inclined to the front surface of the water tank 100.

While the user demounts the water tank 100, the water contained in the water tank 100 might fall on the upper surface 300*a* of the water level sensor unit 300.

If water accumulates on the upper surface 300*a* of the water level sensor unit 300, a water level detection error might occur.

Accordingly, according to the present disclosure, the upper surface 300*a* may be tilted toward the front of the water tank 100 so that it may be possible to prevent remaining water from accumulating, thereby reducing malfunction due to the remaining water.

In addition, the first bottom surface 111 of the water tank 100, which corresponds to the upper surface 300*a* of the water level sensor unit 300, may be also tilted toward the front surface of the water tank 100.

In this instance, the upper surface 300*a* of the water level sensor unit 300 and the first bottom surface 111 of the water tank 100 may have substantially the same inclination.

Since the first bottom surface of the water tank 100 is also inclined toward the front surface of the water tank 100, residual water can be prevented from pooling even inside the water tank 100

The upper surface 300*a* of the water level sensor unit 300 and the first bottom surface 111 may directly contact each other to increase sensor sensibility of the water level sensor unit 300.

In order to reduce damage to the upper surface 300*a* of the water level sensor unit 300, which might occur due to the repeated mounting and demounting process of the water tank 100, the upper surface 300*a* of the water level sensor unit 300 may be spaced a preset distance of 2 mm or less from each other from each.

When the distance between the upper surface 300*a* of the water level sensor unit 300 and the first bottom surface 111 exceeds 2 mm, the sensor sensibility of the water level sensor unit 300 might be greatly deteriorated.

A distance between the front surface of the water level sensor unit 300 and the bottom connecting surface 113 may be farther than the distance between the upper surface 300*a* of the water level sensor unit 300 and the first bottom surface 111.

The water level formed on the first bottom surface 111 may be measured by the water level sensor 320 secured to the upper surface 300*a* of the water level sensor unit 300.

If the distance between the front surface 300*c* of the water level sensor unit 300 and the bottom connecting surface 113 is substantially equal to or shorter than the distance between the upper surface 300*a* of the water level sensor unit 300 and the first bottom surface 111, following disadvantages might occur.

For example, even if the water level becomes lower than the first bottom surface 111 only to be formed on the bottom connecting surface 113, one end of the water level sensor unit, which is close to the bottom connecting surface 113, may detect the presence of water 101 contacting the bottom connecting surface 113 so that a detection error of failing to guide a preset water shortage operation could occur.

According to the present disclosure, the distance between the front surface 300*c* of the water level sensor unit 300 and the bottom connecting surface 113 may be formed greater than the distance between the upper surface 300*a* of the water level sensor unit 300 and the first bottom surface 111, thereby reducing the possibility of detection error occurring in the water level sensor 320.

In this instance, the front surface 300*c* of the water level sensor unit 300 and the bottom connecting surface 113 may be spaced a distance exceeding 2 mm apart from each other.

Figure 8:
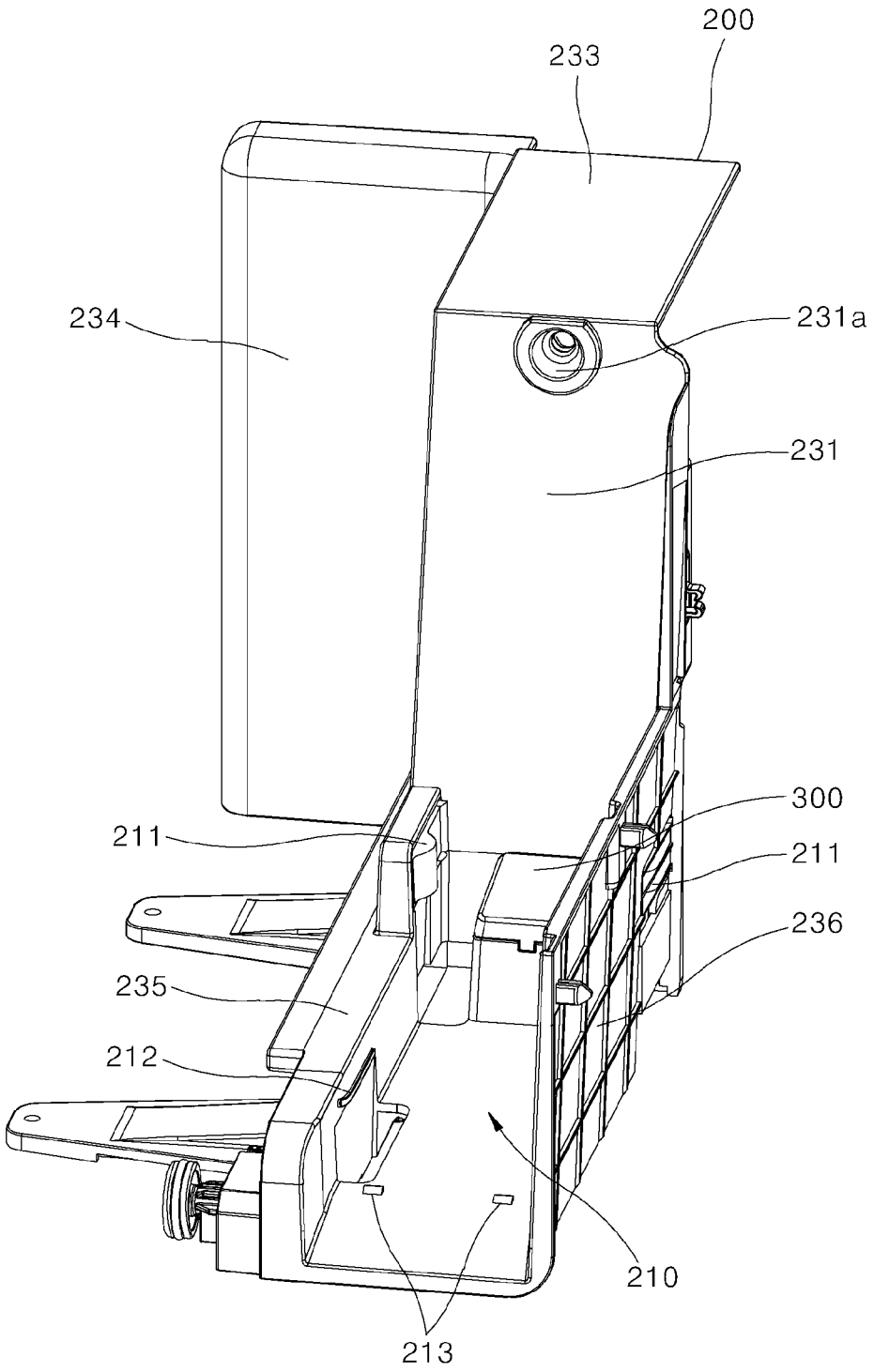
FIG. 8 is a perspective view showing a water tank accommodating portion in a state where a water tank is demounted from a case.

Hereinafter, referring to FIGS. 8 to 10, the securing portion of the case 200 for securing the water tank 100 will be described in detail.

A water tank accommodating portion 210 of the case 200 may include one or more of a first side securing portion 211 disposed to secure a rear lateral surface of the water tank 100, a second side securing portion 212 disposed to secure a front lateral surface of the water tank 100, and a bottom securing portion 213 disposed to secure a front lower surface of the water tank 100.

Accordingly, since one or more of the securing portions may be disposed in the lateral surface and/or the lower surface of the water tank 100 to firmly secure the water tank 100 accommodated in the water tank accommodating portion 210 of the case 200, the water tank 100 may be strongly secured to minimize the distance between the water tank 100 and the water level sensor unit 300 and the operational stability of the water level sensor unit 300 may be secured.

For example, the pair of first side securing portions 211 protruding toward the water tank 100 to face each other may be detachable footrests protruding inward.

Figure 10:
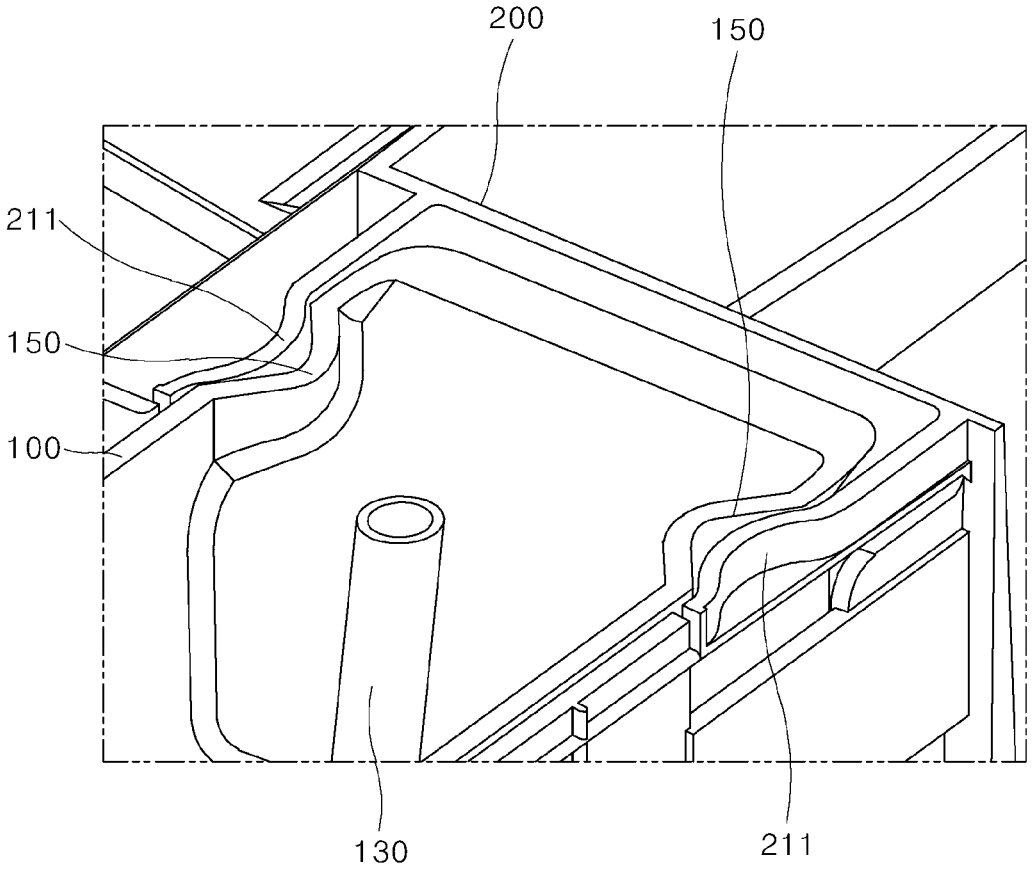
FIG. 10 is a sectional perspective view cut away in a horizontal direction.

Referring to FIG. 10, the first side securing portions 211 may be formed on the lateral surfaces of the water tank 100 and coupled to a pair of side recesses 150 formed on the both lateral surfaces of the water tank, respectively, to restrict the movement of the water tank 100.

The pair of first side securing portions 211 may be formed on the first lateral wall 235 and the second lateral wall 236, respectively.

For example, the second side securing portion 212 may be formed in a rod shape that is long in a front-rear direction, with a front surface inclined upward to facilitate easy guide of mounting the water tank 100.

Figure 9:
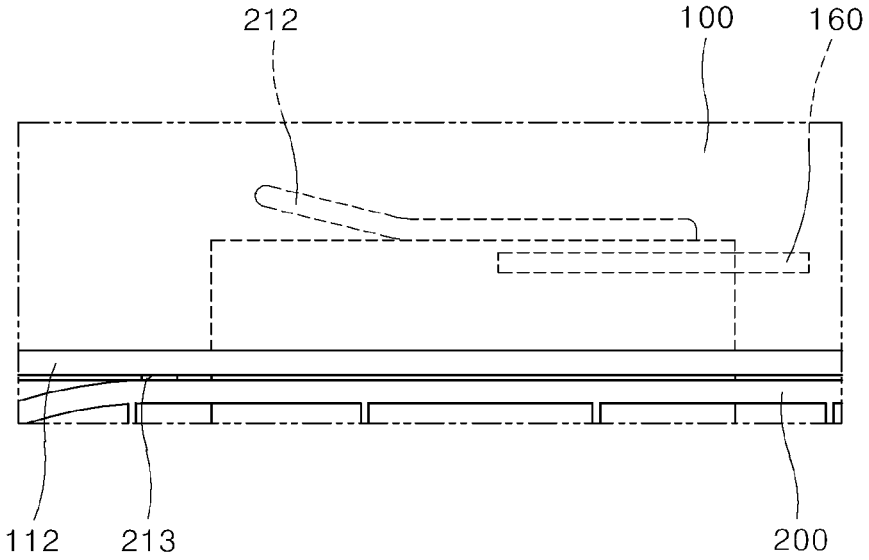
FIG. 9 is a sectional view cut away in a vertical direction to show a second lateral surface securing portion and a second lower surface securing portion.

Referring to FIG. 9, the second side securing portion 212 may serve as a guide for the water tank guide 160 to guide the movement of the water tank 100 and secure the water tank 100 simultaneously.

For example, the bottom securing portion 213 may be formed as one or more protrusions protruding upward to contact the lower surface of the water tank 100, and may be configured to restrict the movement of the water tank 100.

Figure 12:
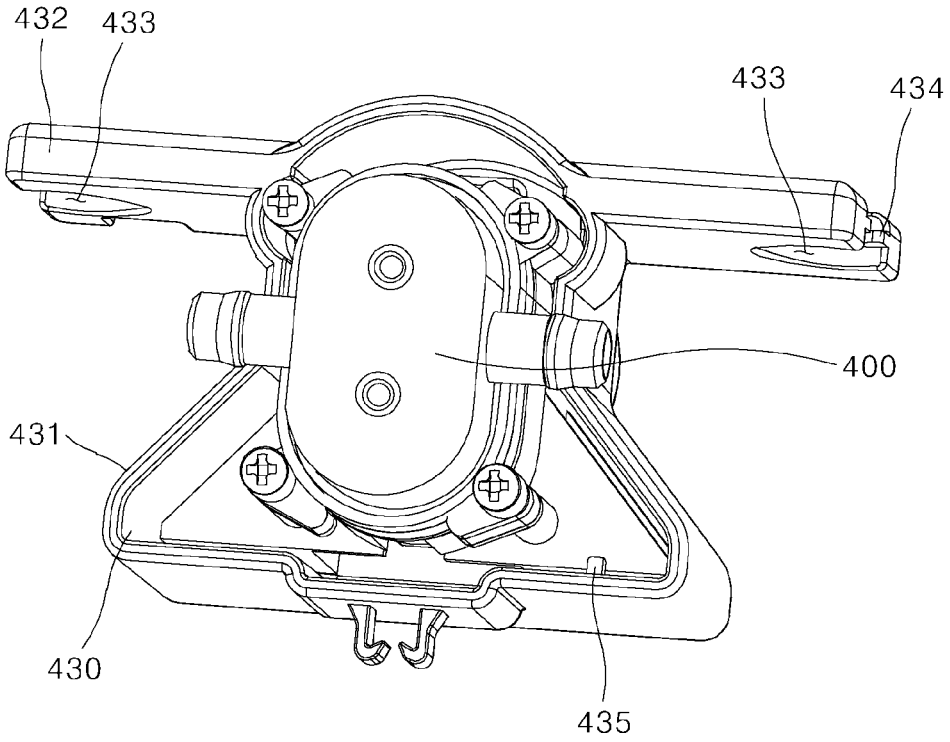
FIG. 12 is a perspective view showing a holder bracket in which a pump is inserted.
Figure 13:
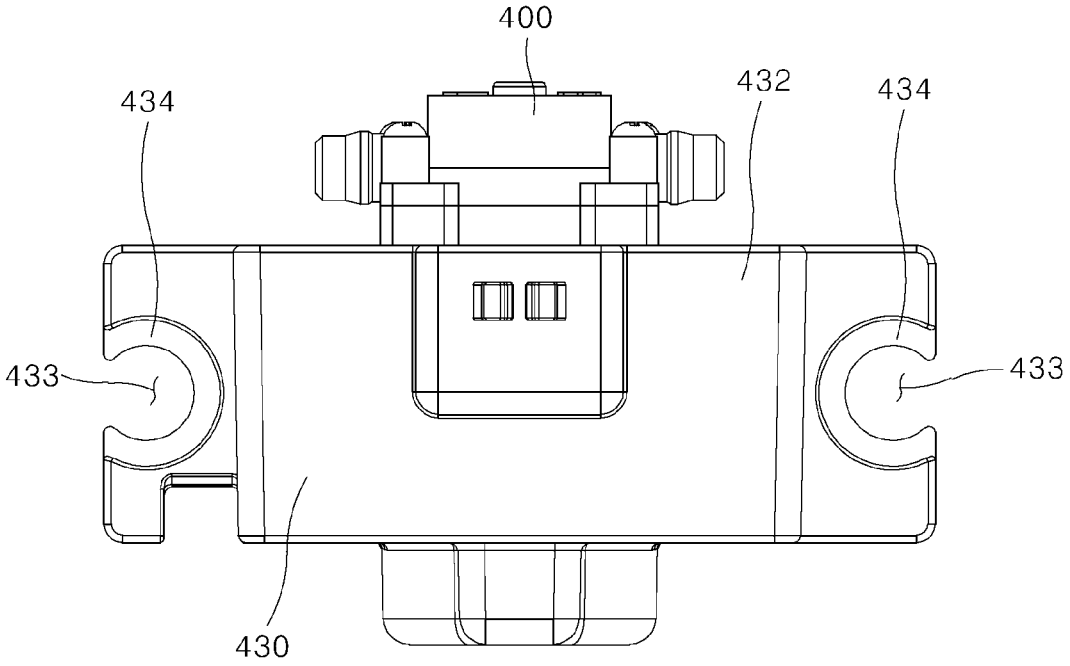
FIG. 13 is a plane view showing a holder bracket in which a pump is inserted.

Hereinafter, referring to FIGS. 12 to 14, the structure of coupling the pump 400 and the holder bracket 430 surrounding the pump 400 will be described in detail.

A predetermined area of the pump 400 may be fixedly inserted in the holder bracket 430.

The holder bracket 430 may include a body 431 accommodating the pump 400 and a wing 432 longitudinally extending from an upper end of the body 431 in both directions.

The body 431 may be configured to secure the pump 400 by accommodating it. Accordingly, the body 431 may have a shape corresponding to the pump 400.

The pump 400 secured in the body 431 may be fastened by screw-fastening but the present disclosure is not limited thereto.

The body 431 may have a shape with an open surface in which the pump 400 is inserted.

The pump 400 inserted in the body 431 may have a predetermined area connected to the first tube 410 and the second tube 420, and the area may be exposed to the outside, without being inserted in the body 431.

Once the pump 400 is inserted in the body 431, molding liquid may be injected into the body 431 for securing the pump.

In this instance, the pump 400 may be lifted outward due to buoyancy caused by injection of the molding liquid.

Accordingly, a securing rib 435 protruding to lock the movement of the pump 400 inserted in the body 431 may be formed inside the body 431.

The securing rib 435 may be inclinedly protruded in a direction which the pump 400 is inserted so that the pump 400 can be easily inserted and difficult to be decoupled after inserted.

Since the securing rib 435 protruding to lock the movement of the pump 400 is disposed inside the body 431 of the holder bracket 430, the pump 400 may be prevented from being lifted by the buoyancy due to the molding liquid injected into the holder bracket 430.

A through hole 433 with one side cut away may be formed in each of both side ends of the wing 432 provided in the holder bracket 430.

For example, since both side ends of the wing 432 are open, the through hole 433 may have a circular shape with a predetermined cut-away area.

A fitting guide 434 may protrude along an inner circumference of the through hole 433 having the predetermined cut-away area.

The fitting guide 434 may be formed thinner than the wing 432 and disposed along a center of the inner circumference of the through hole 433.

A pair of second fastening portions 240 may be formed on the second partition wall 232 of the case 200 to secure the holder bracket 430.

The second fastening member 460 may penetrate the through hole 433 of the holder bracket 430 and then secure the holder bracket 430 to the second fastening portion 240.

The second fastening member 460 may be a screw bolt, and the second fastening member 460 and the second fastening portion 240 may be fastened to each other by a bolt-fastening structure.

Figure 14:
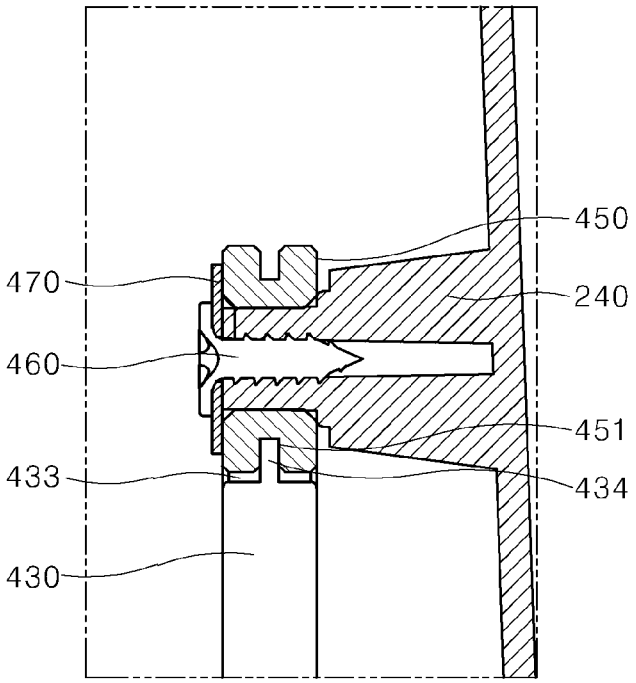
FIG. 14 is a sectional view along B-B' of FIG. 11.

Referring to FIG. 14, the second fastening portion 240 and the through-hole 433 may be coupled to each other by the second fastening member 460. However, a damper 450 configured to surrounding the second fastening portion 240 may be disposed between the through-hole 433 and the second fastening portion 240.

The damper 450 may surround a front end protruding from the second fastening portion 240, and it may have a circular shape.

The circular-shaped damper 450 may include a guide coupling portion 541 recessed along an outer circumferential center.

In this instance, the guide coupling portion 451 of the damper 450 may have a recessed shape corresponding to the protruding shape of the fitting guide 434.

As the damper 450 is inserted in the through-hole 433 having the cut-away area, the guide coupling portion 451 may be fitted to the fitting guide 434.

The damper 450 may be made of a rubber material having elasticity to reduce noise and vibration of the pump 400.

While the holder bracket 430 is fastened to the second fastening portion 240 by the second fastening member 460, the second fastening portion 240 may be disposed between the holder bracket 430 and the second fastening portion 240 only to reduce noise and vibration of the pump 400.

In addition, a washer 470 may be disposed between the second fastening member 460 and the second fastening portion 240.

One surface of the washer 470 may be in contact with the second fastening member 460 and the other surface thereof may be in contact with the second fastening portion 240 and the damper 450. Accordingly, the fastening friction force may be increased enough to strongly secure the holder bracket 430 to the second fastening portion 240.

The water supplied to the water tank 100 may flow through the first tube 410, the pump 400, the second tube 420 and the third tube 260.

The third tube 260 may be a long pipe type hose to be connected to a valve.

The second partition wall 232 of the case 200 may include a first locking portion 251, a second locking portion 252 and a third locking portion 253 which are coupled to the third tube 260 in a different direction to lock it.

The first locking portion 251, the second locking portion 252 and the third locking portion 253 may have a shape protruding to be bent from the second partition wall 232.

The directions in which the first locking portion 251, the second locking portion 252 and the third locking portion 253 are bent may be different from each other.

Figure 11:
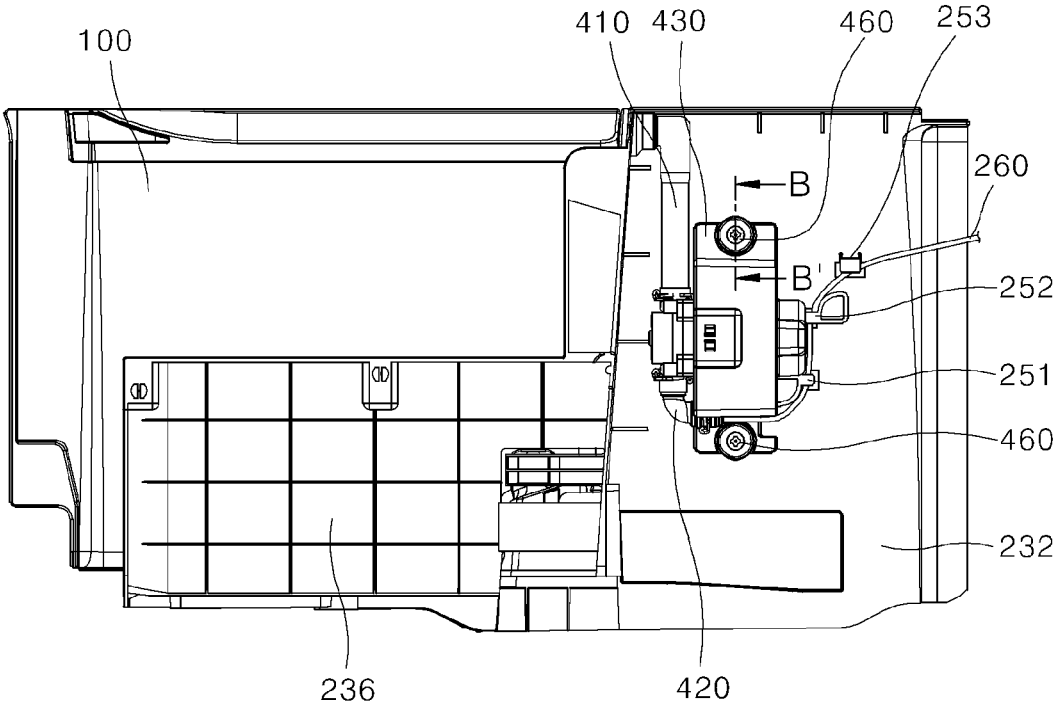
FIG. 11 is a side view showing a pump accommodating portion accommodating a pump in a state where a water tank is coupled to a case.

For example, with respect to FIG. 11, the first locking portion 251 may be bent rightward and the second locking portion 252 may be bent leftward. Also, the third locking portion 253 may be bent downward.

The third tube locked to the first locking portion 251, the second locking portion 252 and the third locking portion 253, that are bent in different directions, may be locked by the forces in different directions.

One or more of the first through third locking portions 251, 252 and 253 may be formed in a curved shape to guide the third tube 260 without bending.

Accordingly, the third tube 260 may be locked to one or more of the locking portions formed in the curved shape to be secured without bending.

As described above, since the third tube 260 connected to the pump 400, through which water flows, is locked to the plurality of locking portions for locking the third tube with forces applied in different directions, the detachment of the tub during work and part movement may be reduced.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A refrigerator comprising:

a case;

a water tank configured to be mounted to the case; and a water level sensor unit that is coupled to the case and overlaps with a lower surface of the water tank, the water level sensor unit being configured to detect a water level inside the water tank, wherein the water level sensor unit comprises:

a water level sensor case, and a water level sensor that is accommodated in the water level sensor case and fixed to an inner upper surface of the water level sensor case, the water level sensor being configured to detect the water level inside the water tank, and wherein an upper surface of the water level sensor case and an upper surface of the water level sensor are inclined with respect to a bottom surface of the case and extend toward a front surface of the water tank.

2. The refrigerator of claim 1, wherein the case defines an opening that receives at least a portion of the water level sensor unit, and wherein the upper surface of the water level sensor case and the upper surface of the water level sensor are exposed to an outside of the case through the opening.

3. The refrigerator of claim 2, wherein the water level sensor case comprises:

a sensor front hook disposed at an inner front surface of the water level sensor case; and a pair of tension ribs that are disposed at inner side surfaces of the water level sensor case and face each other, the pair of tension ribs including sensor side hooks coupled to lateral surfaces of the water level sensor, and wherein the sensor front hook and the sensor side hooks fix the water level sensor to the inner upper surface of the water level sensor case.

4. The refrigerator of claim 1, further comprising a pump, wherein the case comprises one or more partition walls that define a plurality of spaces including:

a water tank accommodating portion that accommodates the water tank; and a pump accommodating portion that accommodates the pump, and wherein the one or more partition walls partition the water tank accommodating portion and the pump accommodating portion from each other.

5. The refrigerator of claim 4, further comprising a refrigerator compartment, wherein the case is disposed inside the refrigerator compartment.

6. The refrigerator of claim 5, wherein the one or more partition walls comprise:

a first partition wall that partitions the water tank accommodating portion and the pump accommodating portion from each other;

a second partition wall that extends rearward from a lateral side end of the first partition wall; and a third partition wall that extends rearward from an upper end of the first partition wall, wherein the water tank is configured to be disposed at a front side of the first partition wall and exposed to the refrigerator compartment, and wherein the pump is disposed at a rear side of the first partition wall, and the first partition wall covers the pump from the refrigerator compartment.

7. The refrigerator of claim 1, wherein the case defines a water tank accommodating portion configured to accommodate the water tank, and wherein the case comprises at least one of:

a first side securing portion disposed at the water tank accommodating portion and configured to support a rear lateral surface of the water tank, a second side securing portion disposed at the water tank accommodating portion and configured to support a front lateral surface of the water tank, or a bottom securing portion disposed at the water tank accommodating portion and configured to support a front lower surface of the water tank.

8. The refrigerator of claim 7, wherein the water tank defines a pair of side recesses at lateral surfaces thereof, and wherein the first side securing portion is one of a pair of first side securing portions that face each other and protrude toward the water tank, the pair of first side securing portions being configured to, based on coupling to the pair of side recesses, restrict movement of the water tank in the water tank accommodating portion.

9. The refrigerator of claim 7, wherein the water tank comprises a water tank guide disposed at a lateral surface of the water tank, and wherein the second side securing portion is configured to, based on the water tank being detached from the water tank accommodating portion, guide movement of the water tank along the water tank guide.

10. The refrigerator of claim 7, wherein the bottom securing portion protrudes upward from the bottom surface of the case and is configured to contact the front lower surface of the water tank and to restrict movement of the water tank in the water tank accommodating portion.

11. The refrigerator of claim 1, further comprising:

a pump; and a holder bracket that surrounds at least a portion of the pump, wherein the case defines a pump accommodating portion that accommodates the pump, the case comprising a plurality of pump fastening portions disposed at the pump accommodating portion and coupled to the holder bracket, wherein the holder bracket defines a plurality of through-holes that receive the plurality of pump fastening portions, respectively, and wherein the refrigerator further comprises:

a pump fastening member that couples a pump fastening portion of the plurality of pump fastening portions to a through-hole of the plurality of through-holes, and a damper that is disposed between the through-hole and the pump fastening portion and surrounds the pump fastening portion.

12. The refrigerator of claim 11, wherein the holder bracket comprises a fitting guide that is disposed in the through-hole and extends along an inner circumference of the through-hole, the inner circumference of the through-hole having a cut-away portion that is open to an outside of the holder bracket, wherein the damper comprises a guide coupling portion that is recessed along an outer circumference of the damper and receives the fitting guide, and wherein the damper is inserted into the through-hole through the cut-away portion and couples the guide coupling portion to the fitting guide.

13. The refrigerator of claim 12, further comprising a washer disposed between the pump fastening member and the pump fastening portion, the washer having (i) a first surface that is in contact with the pump fastening member and (ii) a second surface that is in contact with the pump fastening portion and the damper.

14. The refrigerator of claim 1, further comprising:

a pump; and a holder bracket that surrounds at least a portion of the pump and defines an open surface that receives the pump, the holder bracket comprising a securing rib that protrudes from an inside of the holder bracket and is configured to restrict movement of the pump in the holder bracket.

15. The refrigerator of claim 1, further comprising a storage disposed at a side of the case, wherein the case comprises a guide rail disposed at a lateral surface of the case and configured to guide movement of the storage.

16. A refrigerator comprising:

a case;

a water tank configured to be mounted to the case; and a water level sensor unit that is coupled to the case and overlaps with a lower surface of the water tank, the water level sensor unit being configured to detect a water level inside the water tank, wherein an upper surface of the water level sensor unit is inclined with respect to a bottom surface of the case and extends toward a front surface of the water tank, and wherein the water tank comprises an inlet portion recessed from a rear lower area of the water tank and configured to accommodate the water level sensor unit.

17. A refrigerator comprising:

a case;

a water tank configured to be mounted to the case; and a water level sensor unit that is coupled to the case and overlaps with a lower surface of the water tank, the water level sensor unit being configured to detect a water level inside the water tank, wherein an upper surface of the water level sensor unit is inclined with respect to a bottom surface of the case and extends toward a front surface of the water tank, and wherein the lower surface of the water tank comprises:

a first bottom surface that overlaps with the water level sensor unit along a vertical direction, the first bottom surface being inclined with respect to the bottom surface of the case and extending toward the front surface of the water tank, and a second bottom surface that does not overlaps with the water level sensor unit along the vertical direction.

18. The refrigerator of claim 17, wherein the first bottom surface is positioned higher than the second bottom surface.

19. The refrigerator of claim 17, wherein the upper surface of the water level sensor unit is in direct contact with the first bottom surface of the water tank.

20. The refrigerator of claim 17, wherein a distance between the upper surface of the water level sensor unit and the first bottom surface of the water tank is less than or equal to 2 mm.

21. The refrigerator of claim 20, wherein the lower surface of the water tank further comprises a bottom connecting surface that connects the first bottom surface and the second bottom surface to each other, and wherein a distance between a front surface of the water level sensor unit and the bottom connecting surface is greater than the distance between the upper surface of the water level sensor unit and the first bottom surface of the water tank.

22. The refrigerator of claim 20, further comprising a tube configured to guide water discharged from the water tank, wherein the case comprises a first locking portion, a second locking portion, and a third locking portion that are coupled to the tube in different directions from one another.

* * * * *